US008621788B2

(12) United States Patent
Tedesco et al.

(10) Patent No.: US 8,621,788 B2
(45) Date of Patent: Jan. 7, 2014

(54) CONNECTOR FOR CONSTRUCTION ELEMENTS AND METHOD OF CONNECTING

(75) Inventors: Dominic Tedesco, Edinburgh (GB); William Rutherford, Hamilton (GB)

(73) Assignee: Dalglen (No. 1158) Limited, Glasgow (GB)

( * ) Notice: Subject to any disclaimer, the term of this patent is extended or adjusted under 35 U.S.C. 154(b) by 45 days.

(21) Appl. No.: 12/992,953

(22) PCT Filed: Apr. 29, 2009

(86) PCT No.: PCT/GB2009/050440

§ 371 (c)(1), (2), (4) Date: Mar. 1, 2011

(87) PCT Pub. No.: WO2009/138770

PCT Pub. Date: Nov. 19, 2009

(65) Prior Publication Data

US 2011/0138733 A1 Jun. 16, 2011

(30) Foreign Application Priority Data

May 16, 2008 (GB) ..... 0808927.8

(51) Int. Cl.
*B25G 3/00* (2006.01)

(52) U.S. Cl.
USPC ..... 52/79.13; 403/230

(58) Field of Classification Search
USPC ..... 52/79.9, 79.13, 79.1, 106, 263; 403/194, 195, 230, 238–240
See application file for complete search history.

(56) References Cited

U.S. PATENT DOCUMENTS

| | | | | |
|---|---|---|---|---|
| 3,653,169 | A | 4/1972 | Jenner | |
| 6,871,453 | B2 * | 3/2005 | Locke | 52/79.13 |
| 7,845,139 | B1 * | 12/2010 | Mansueto et al. | 52/745.15 |

FOREIGN PATENT DOCUMENTS

| | | | |
|---|---|---|---|
| BE | 794 125 | A1 | 7/1973 |
| CH | 611 372 | A5 | 5/1979 |
| FR | 1 002 016 | A | 3/1952 |

OTHER PUBLICATIONS

International Search Report: PCT/GB2009/050449.

* cited by examiner

*Primary Examiner* — William Gilbert
*Assistant Examiner* — Gisele Ford
(74) *Attorney, Agent, or Firm* — Brinks Gilson & Lione

(57) ABSTRACT

There is herein described a connector system. More particularly, there is herein described a connector (100) system which is capable of being used to connect construction modules (120) in a substantially horizontal and/or substantially vertical manner.

9 Claims, 14 Drawing Sheets

CONNECTOR FOR CONSTRUCTION ELEMENTS AND METHOD OF CONNECTING

FIELD OF THE INVENTION

The present invention relates to a connector system. More particularly, the present invention relates to a connector system which is capable of being used to connect construction modules in a substantially horizontal and/or substantially vertical manner.

BACKGROUND OF THE INVENTION

Previously, building modules used in the construction industry had to be aligned manually into either vertical or horizontal positions. This leads to building modules being located in incorrect positions due to manual building labourers having to use, for example, their eye or plumb lines to measure vertical and horizontal orientations. This obviously leads to inaccuracies and a reduction in the structural integrity of buildings. In the event that the modules are placed in an orientation significantly away from the vertical or horizontal orientations, then the building may be significantly weakened.

Moreover, conventionally the walls (i.e. shells) of the majority of residential property such as houses and flats, industrial property such as warehouses and factories, retail property such as shop units and shopping centres, and indeed any other type of building structure, have been constructed from bricks and/or building blocks such as breeze blocks.

The bricks and/or building blocks are adhered to one another using cement. Constructing buildings in this manner is a time consuming process which significantly contributes to the cost of a building. A skilled tradesman is also required in the construction of a brick wall. A brick wall also tends to have imperfections such as slight curvatures and distortions which leads to, for example, difficulties when applying an outer finish such as render.

Furthermore, on the completion of a brick wall, the wall goes through a 'drying-out' process whereupon there may be some shrinkage in the wall which may lead to cracking and a loss of structural integrity.

The building of a brick wall may also be affected by bad weather such as frost and heavy rain. Additionally, brick walls may also be susceptible to dampness as bricks and cement have a tendency to retain moisture.

Building brick walls has the further disadvantage that brick walls are relatively heavy and require deep foundations to support the weight of a formed building. If deep foundations are required, this significantly adds to the cost of a building.

It is an object of at least one aspect of the present invention to obviate or mitigate at least one or more of the aforementioned problems.

It is a further object of at least one aspect of the present invention to provide a connector system which is used to improve the location and/or positioning of building modules.

It is a further object of at least one aspect of the present invention to provide a method for efficiently and cost effectively constructing the framework of a building.

SUMMARY OF THE INVENTION

According to a first aspect of the present invention there is provided a connector capable of connecting construction modules in a substantially horizontal and/or vertical manner, said connector comprising:

a base having a perimeter and a first and a second side;

at least one housing mounted on either the first or second side of the base, the housing comprising at least a first and second face which are either substantially perpendicular or parallel to one another;

a passageway extending through the base and the at least one housing; and wherein the first and second faces on the housing are capable of connecting construction modules in a substantially horizontal and/or vertical manner.

Typically, the base may be a substantially planar structure. In particular embodiments, the base may be substantially rectangular or substantially square in shape.

Conveniently, there may be housings on each of the first and second sides of the base. The connector may therefore comprise two housings on opposite sides of the base.

The at least one or both housings may be substantially centrally located on the first and/or second side of the base.

The passageway may extend through the base and both housings.

By locating the at least one or both housings centrally, a shoulder, stop member or supporting member may be formed around at least partially or all the way around the base. The shoulder, stop member or supporting member may be used as a means to engage with a construction module.

The at least one or both housings may comprise at least a first and second face which are either substantially perpendicular or substantially parallel to one another. The faces are adapted to engage with construction modules and facilitate their placement or orientation into substantially perpendicular or substantially parallel arrangements. Typically, the at least one or both housings may comprise four faces which may be used to engage with construction modules and either facilitate their placement or orientation into substantially perpendicular or substantially parallel arrangements. The four faces may be located on opposite sides of the at least one or both housings. The faces may, for example, be chamfered edges.

The at least one or both housings may be substantially conical in shape and may, for example, be a truncated cone with the passageway extending substantially centrally therethrough.

The connector may be made of any suitable strong material such as a metal, alloy and/or composite material.

There may be a series of connectors attached to one another. For example, there may be two, three, four, five or six connectors attached to one another. The connectors may be attached in a linear manner, an 'L'-shape or in a 2×2 orientation etc.

Construction modules may be connected using the connector. The construction modules may comprise an elongate member which may be inserted into the passageway in the connector. The elongate member may be adapted to fit snugly in the passageway extending through the connector. On insertion of the elongate member of the connector into the connector, a bottom surface of the construction module may abut against the shoulder, stop member or the supporting member formed around the base of the connector. This provides the vertical orientation. As the elongate member is fully fitted into the passageway in the connector, the faces on at least one of the housings abut against an inner surface of the construction module. Typically, there may be at least two, at least three or at least four faces on at least one or both of the housings abutting against an inner surface of the construction module. Preferably, there are four faces on both housings abutting against an inner surface of the construction module. This provides the horizontal orientation. The faces on the housing (s) may therefore connect construction modules in a substantially horizontal and/or substantially vertical manner.

The connector may also comprise openings through which settable material may be injected. This may further secure the construction modules in place by setting around the elongate member inserted into the connector.

According to a second aspect of the present invention there is provided a method of connecting construction modules in a substantially horizontal and/or vertical manner, said method comprising providing a connector comprising:

providing a base having a perimeter and a first and a second side;

providing at least one housing mounted on either the first or second side of the base, the housing comprising at least a first and second face which are either substantially perpendicular or parallel to one another;

providing a passageway extending through the base and the at least one housing; and wherein the first and second faces on the housing are capable of connecting construction modules in a substantially horizontal and/or vertical manner.

DESCRIPTION OF DRAWINGS

Embodiments of the present invention will now be described, by way of example only, with reference to the accompanying drawings in which.

DETAILED DESCRIPTION

Figure 1:
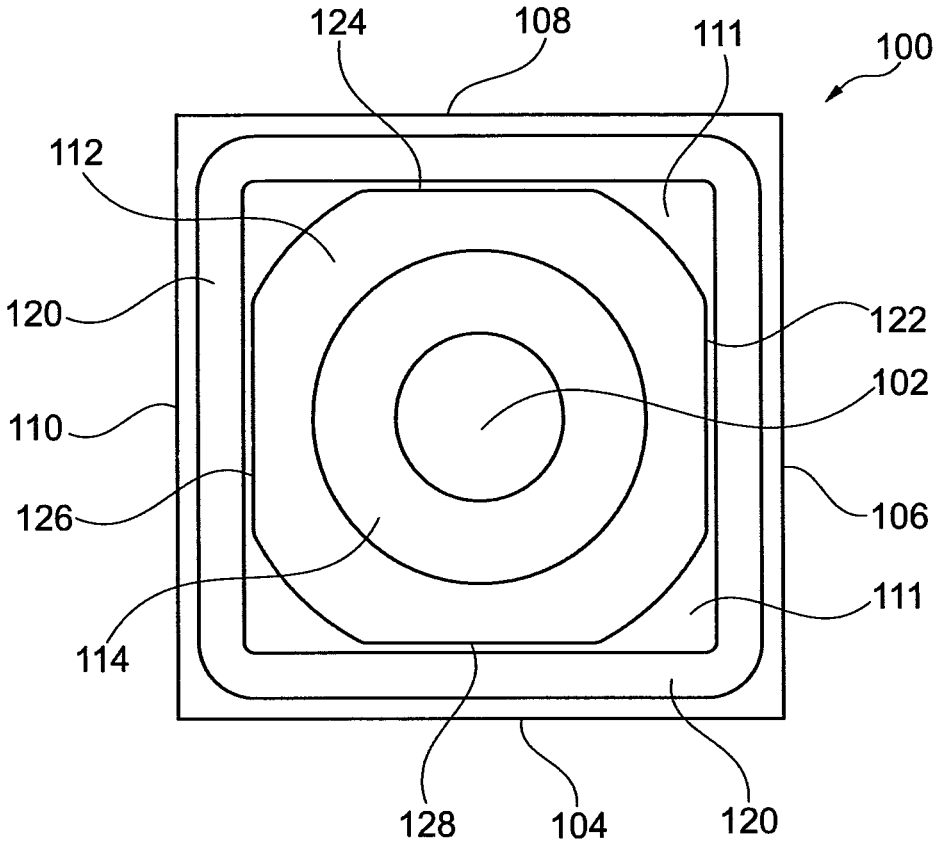
FIG. 1 is a sectional top view of a connector attached to a construction module according to a first embodiment of the present invention.
Figure 2:
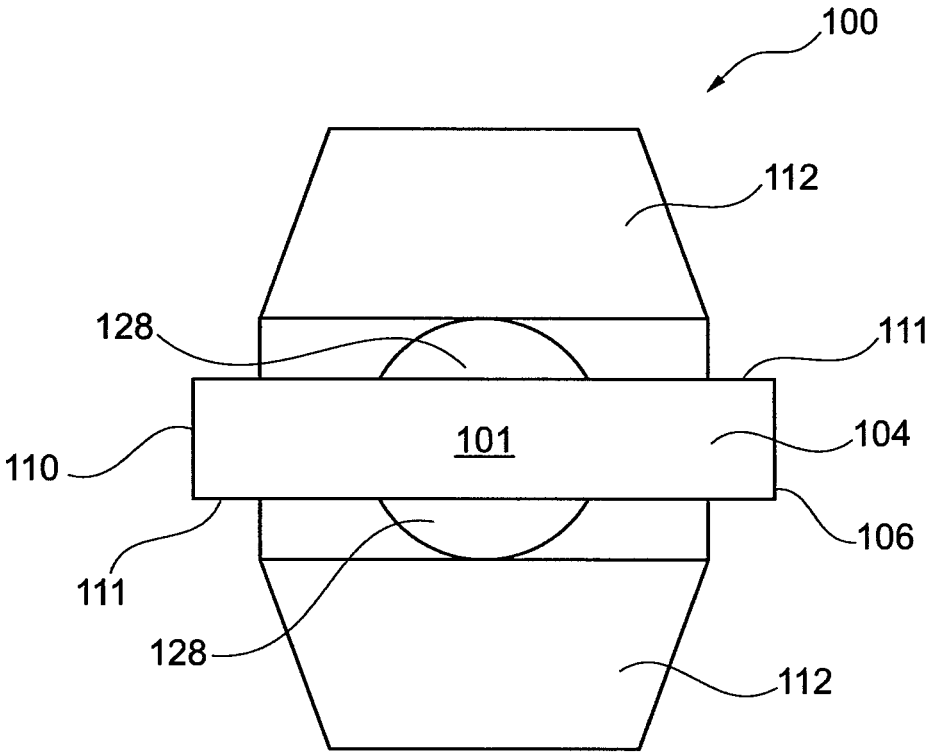
FIG. 2 is a front view of the connector shown in FIG. 1.
Figure 3:
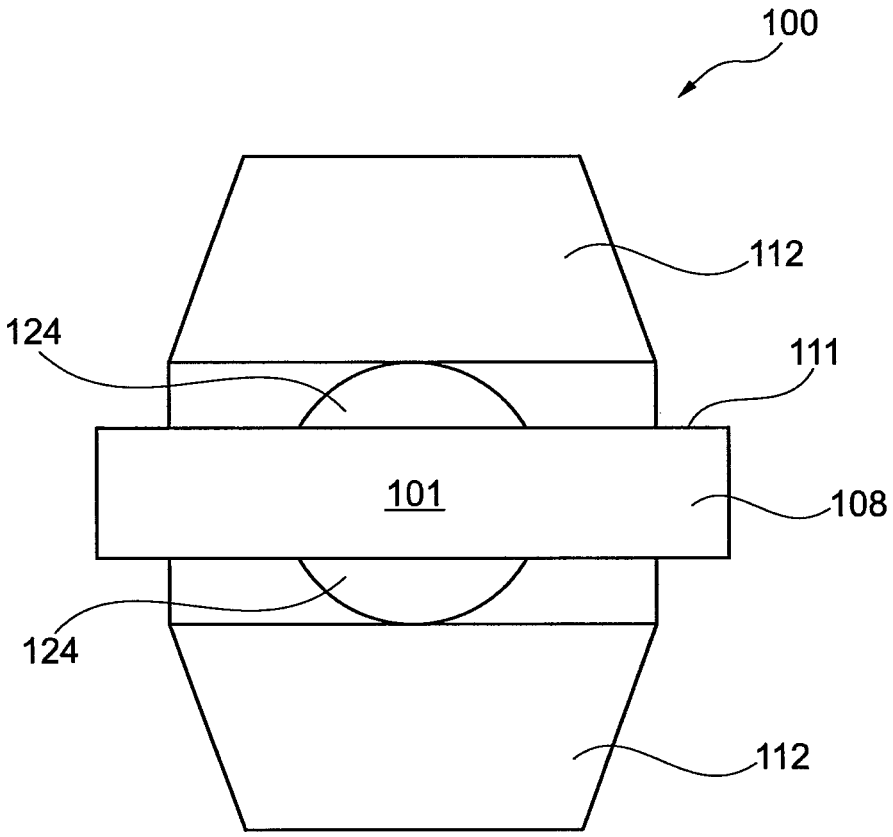
FIG. 3 is a rear view of the connector shown in FIGS. 1 and 2.

FIG. 1 is a general representation of a connector according to the present invention, generally designated 100. The connector 100 in FIG. 1 is surrounded by part of a construction module 120.

The connector 100 as shown in FIGS. 1 to 4 comprises a central base 101 which has four sides 104, 106, 108, 110. The central base 101 is substantially planar and square in shape and may be described as being in the form of a collar.

On both sides of central base 101 there are frusto conical sections 112. The frusto conical section 112 are substantially centrally mounted on the base 101. An extended shoulder 111 is formed around the frusto conical sections 112 which may be used as a stop member against a bottom surface of a construction module 120 as shown in FIG. 1. The extended shoulder 111 may therefore be used to provide vertical positioning for the construction module 120.

Through the centre of the central base 101 and the frusto conical sections 112 there is a passageway 102. The passageway 102 may function to facilitate the positioning of construction modules.

Around the frusto conical sections 112 there are four angular faces 122, 124, 126 128 which are capable of connecting construction modules in a substantially horizontal and/or vertical manner. The four faces 122, 124, 126, 128 are oriented substantially perpendicular or parallel to one another. The four faces 122, 124, 126, 128 may be considered to be chamfered edges.

Figure 4:
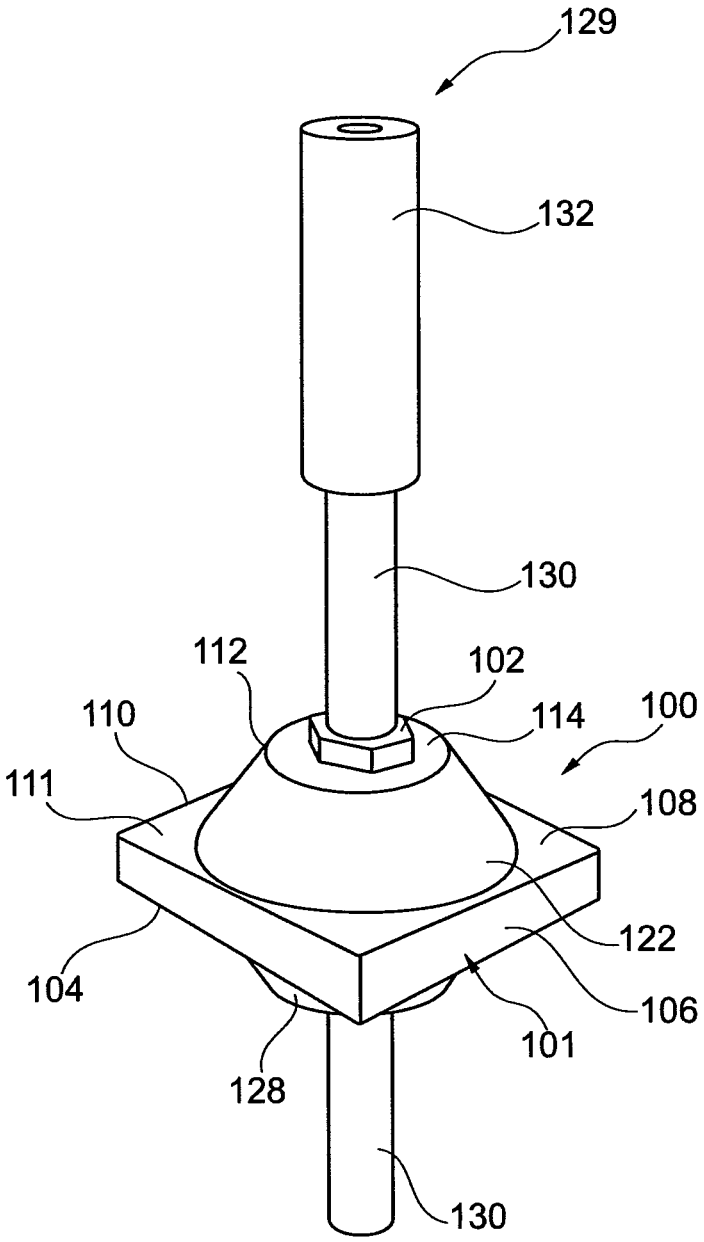
FIG. 4 is a view of a construction module being inserted into a connector as shown in FIGS. 1 to 3.

As shown in FIG. 4, on insertion of an elongate member 130 from a construction module 120 into the passageway 102 in the connector 100, the construction module 120 is correctly positioned. As the inside surface of the connector module 120 abuts against the frusto conical section 112, the connector module will be slid and/or guided into place and then finally correctly aligned by using the faces 122, 124, 126, 128.

It is therefore easy and fast for a workman to correctly position the construction module 120. As the elongate member 130 is fully inserted into the passageway 102, the sides of the construction module 120 as shown in FIG. 1 are correctly positioned by the four faces 122, 124, 126, 128 on the connector 100. The connector 100 is therefore used to correctly connect construction modules in a substantially horizontal and/or vertical manner with the four faces 122, 124, 126, 128 acting as guide members.

Figure 5:
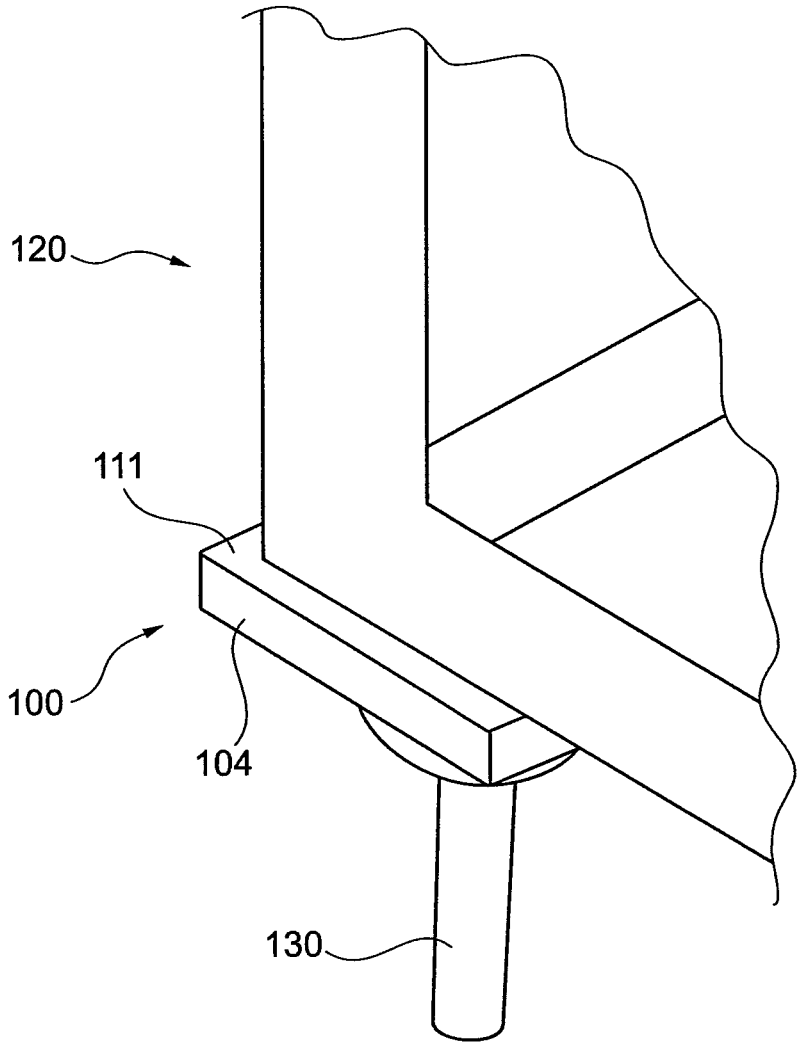
FIG. 5 is a perspective view of a construction module attached to a connector as shown in FIGS. 1 to 4.

FIG. 5 shows the construction module 120 attached to the connector 100. The construction module 120 is therefore positioned in the correct vertical and horizontal position.

Figure 6:
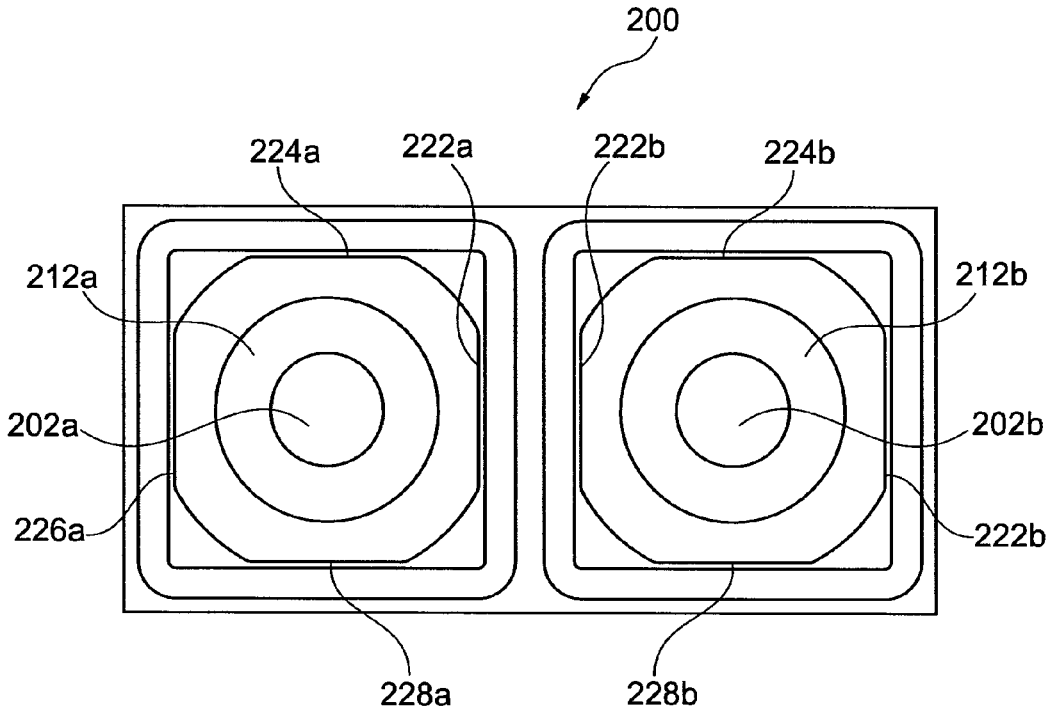
FIG. 6 is sectional top view of a connector attached to a construction module according to a second embodiment of the present invention.
Figure 7:
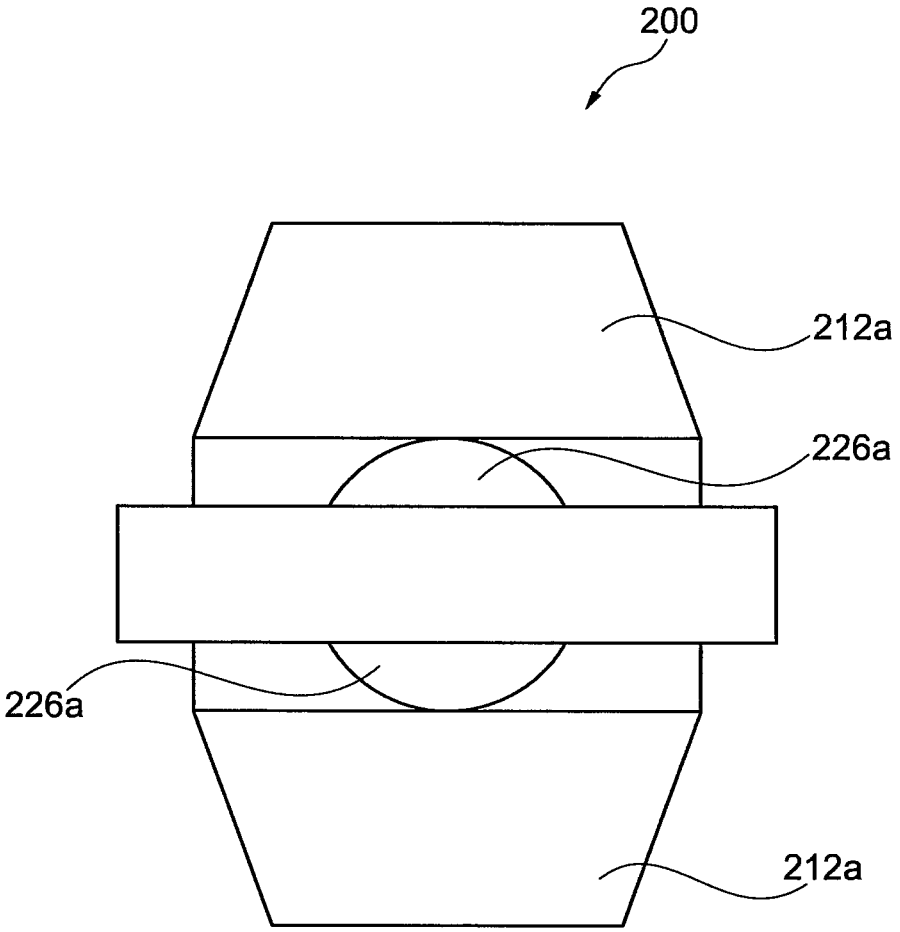
FIG. 7 is a front view of the connector shown in FIG. 6.
Figure 8:
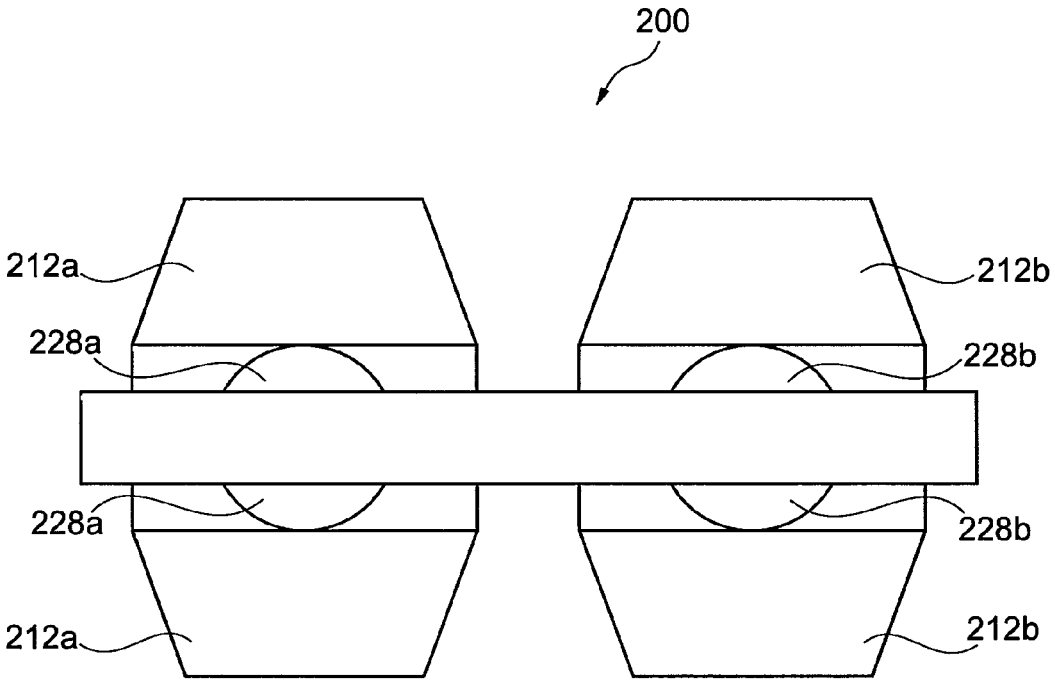
FIG. 8 is a rear view of the connector shown in FIGS. 6 and 7.

FIGS. 6 and 8 show a second connector 200 which is similar to that shown in FIGS. 1 to 5 but two connectors are now attached in series. As shown in FIGS. 6 to 8 there are again four faces 222*a*, 224*a*, 226*a*, 228*a* and 222*b*, 224*b*, 226*b*, 228*b* around frusto conical sections 212*a*, 212*b*, respectively. Each of the connectors has a passageway 202*a*, 202*b*.

Figure 9:
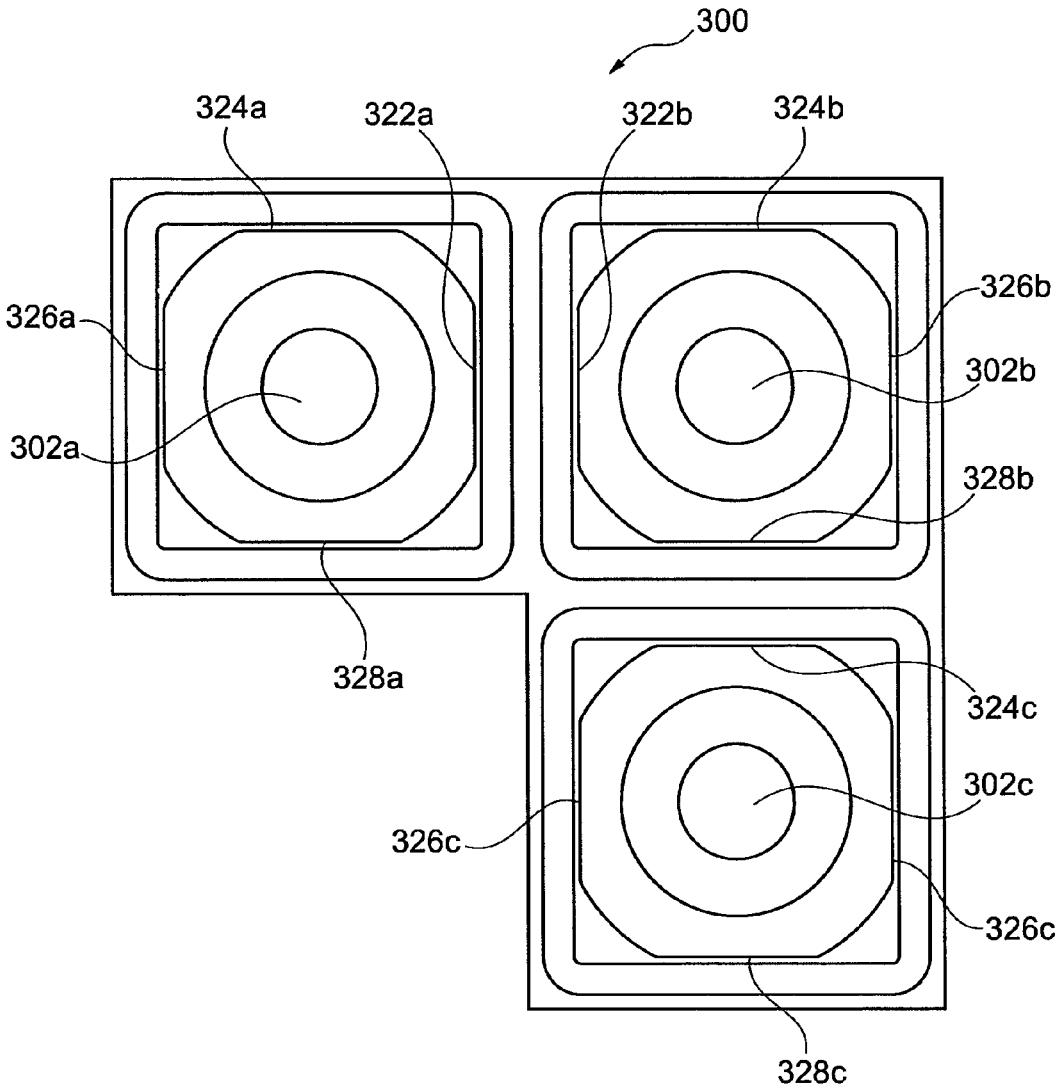
FIG. 9 is sectional top view of a connector attached to a construction module according to a third embodiment off the present invention.
Figure 10:
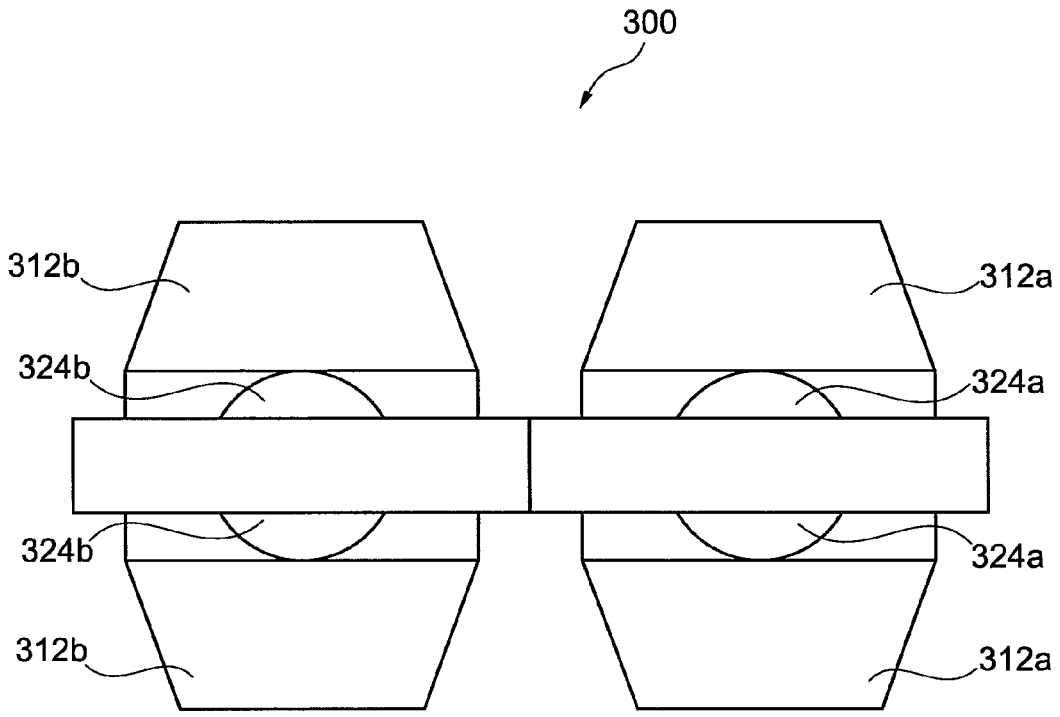
FIG. 10 is a front view of the connector shown in FIG. 9.
Figure 11:
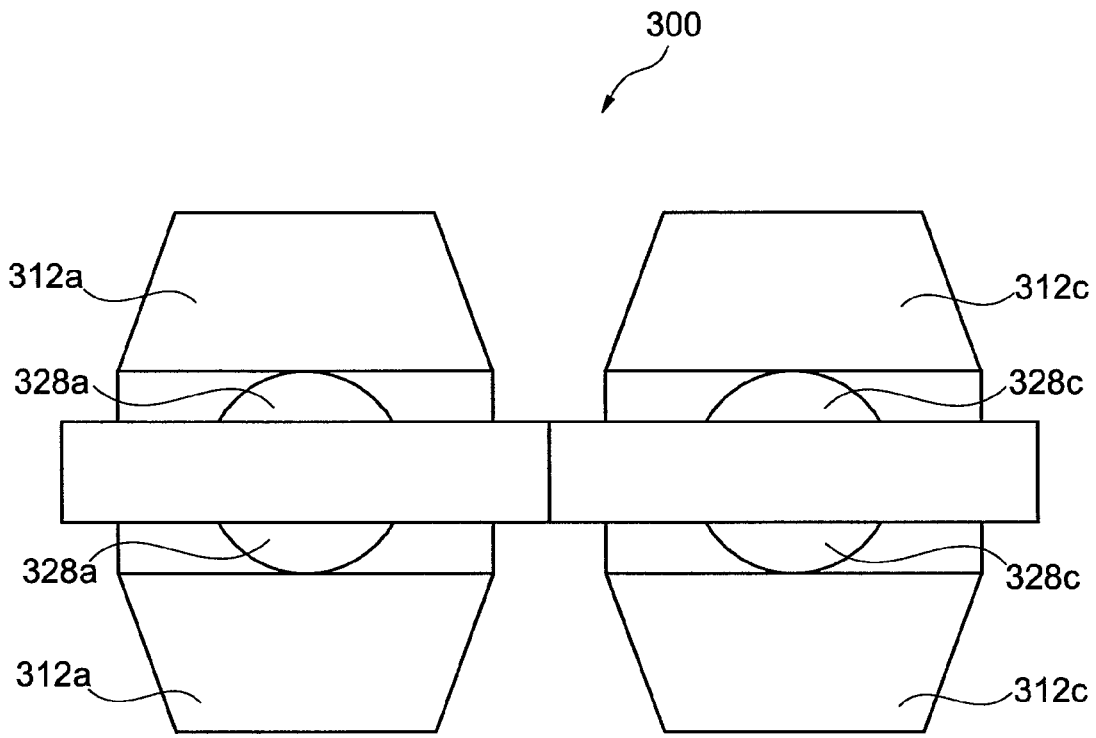
FIG. 11 is a rear view of the connector shown in FIGS. 9 and 10.

FIGS. 9 to 11 show a third connector 300 which is similar to that shown in FIGS. 1 to 5 but three connectors are now attached in an L-shape configuration. As shown in FIGS. 9 to 11 there are again four faces 322*a*, 324*a*, 326*a*, 328*a*; 322*b*, 324*b*, 326*b*, 328*b* and 322*c*, 324*c*, 326*c*, 328*c* around frusto conical sections 213*a*, 312*b*, 312*c*, respectively. Each of the connectors has a passageway 302*a*, 302*b*, 302*c*.

Figure 12:
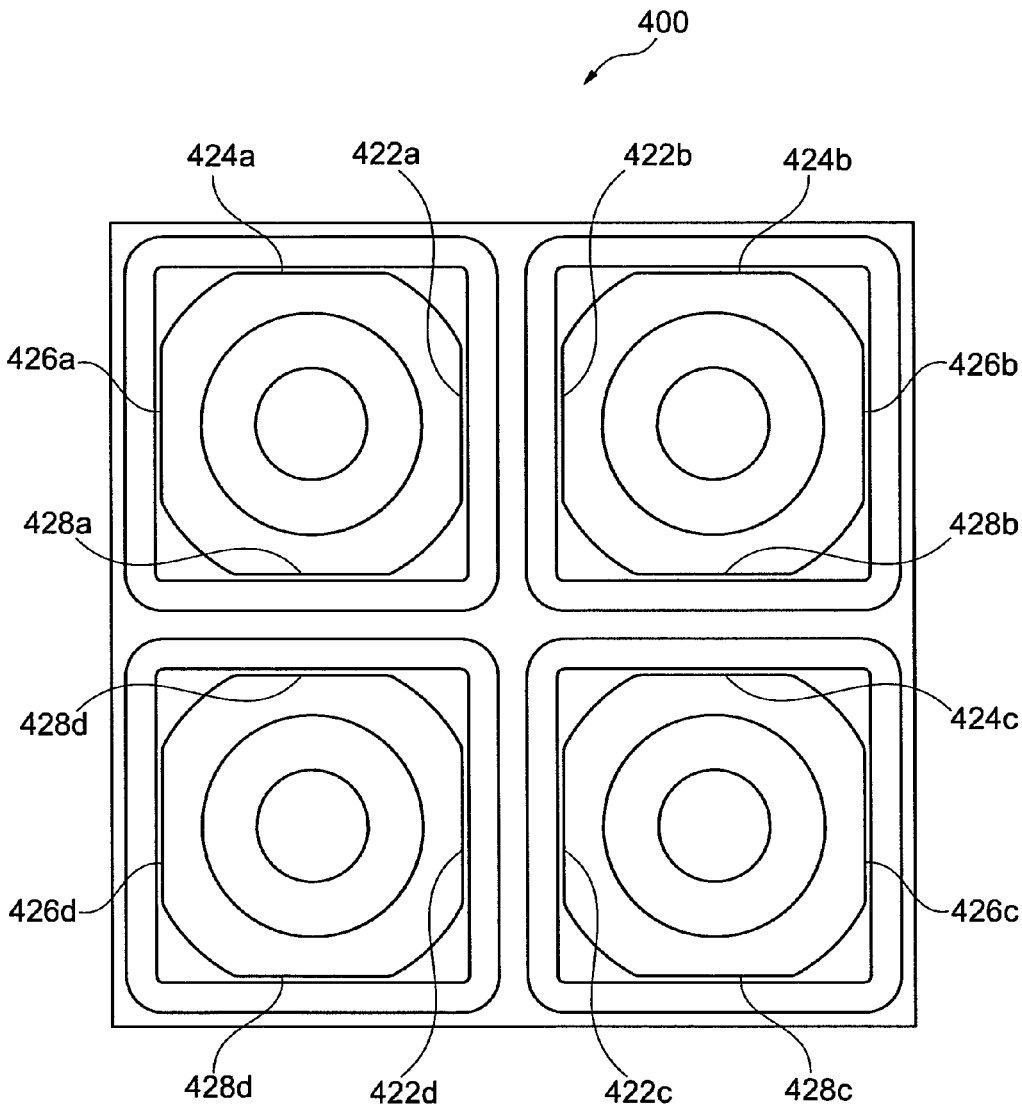
FIG. 12 is sectional top view of a connector attached to a construction module according to a fourth embodiment of the present invention.
Figure 13:
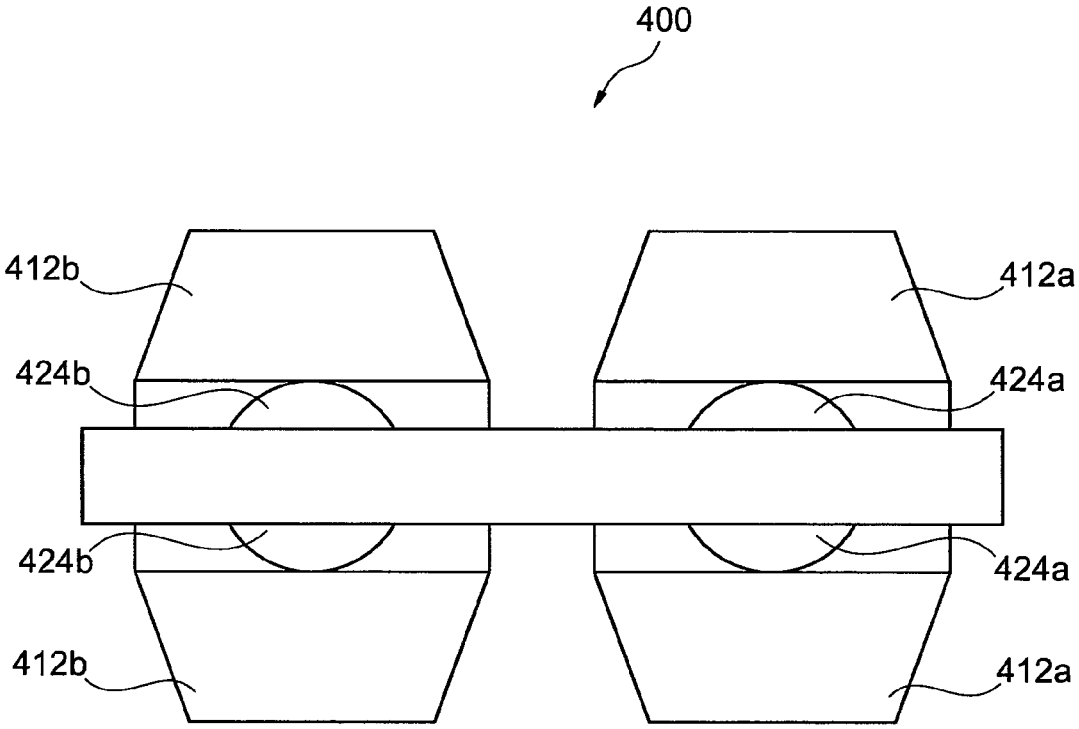
FIG. 13 is a front view of the connector shown in FIG. 12.
Figure 14:
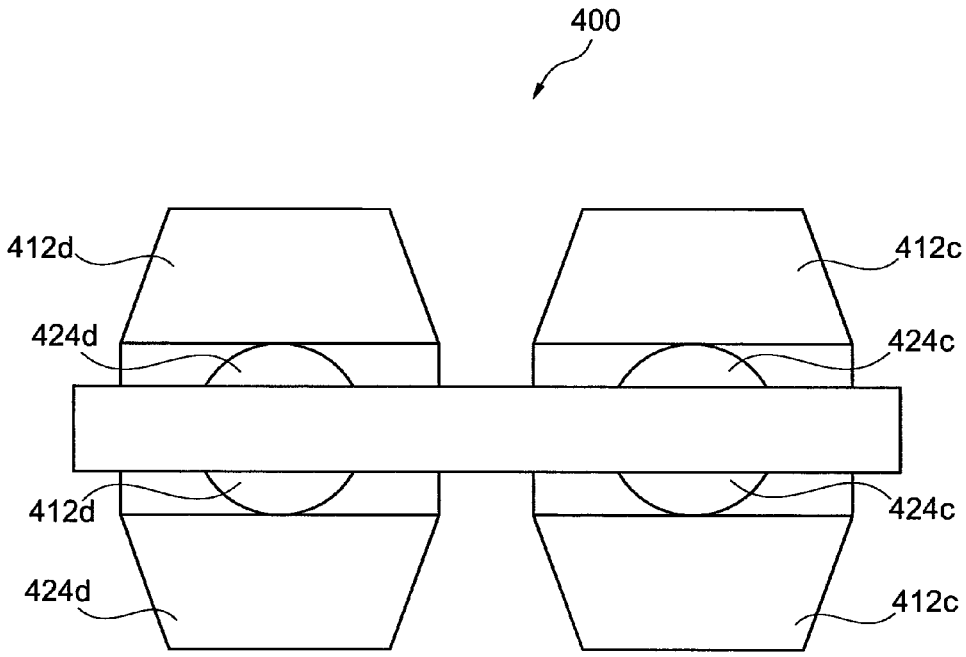
FIG. 14 is a rear view of the connector shown in FIGS. 12 and 13.

FIGS. 12 to 14 show a fourth connector 400 which is similar to that shown in FIGS. 1 to 5 but four connectors are now attached into a square-like configuration. As shown in FIGS. 12 to 14 there are again four faces 422*a*, 424*a*, 426*a*, 428*a*; 422*b*, 424*b*, 426*b*, 428*b*; 422*c*, 424*c*, 426*c*, 428*c* and 422*d*, 424*d*, 426*d*, 428*d* around frusto conical sections 412*a*, 412*b*, 412*c*, 412*d*, respectively. Each of the connectors has a passageway 402*a*, 402*b*, 402*c*, 402*d*.

Whilst specific embodiments of the present invention have been described above, it will be appreciated that departures from the described embodiments may still fall within the scope of the present invention. For example, any suitable type of connector may be used which has faces which may be used to position the construction modules in a substantially horizontal and/or vertical manner.

The invention claimed is:

1. A connector capable of connecting construction modules in a substantially horizontal and/or vertical manner, said connector comprising:

a base having a perimeter and a first and a second side;

at least one housing mounted on either the first or second side of the base, the housing comprising at least a first face, a second face, a third face, and a fourth face which are either substantially perpendicular or parallel to one another;

a passageway extending through the base and the at least one housing;

wherein the faces on the housing are chamfered edges operable to connect construction modules in a substantially horizontal and/or vertical manner;

wherein the faces on each housing engage with a respective construction module and facilitate placement and orientation of adjacent construction modules into substantially perpendicular or parallel arrangement relative to adjacent construction modules; and wherein the at least one or both housings is substantially conical in shape.

2. A connector according to claim 1, wherein the base is a substantially planar structure.

3. A connector according to claim 1, wherein the base is substantially rectangular or substantially square in shape.

4. A connector according to claim 1, wherein the at least one or both housings are substantially centrally located on the first and/or second side of the base.

5. A connector according to claim 1, wherein the passageway extends through the base and the at least one or both housings.

6. A combination of a connector according to claim 1 and a construction module, wherein the construction module comprises an elongate member which is capable of being inserted into the passageway in the connector.

7. A combination according to claim 6, wherein on insertion of the elongate member of the construction module into the connector, a bottom surface of the construction module is capable of abutting against the shoulder, stop member or the supporting member formed around the base of the connector to thereby provide substantially vertical orientation.

8. A combination according to claim 6, wherein as the elongate member of the construction module is fully fitted into the passageway in the connector, the faces on at least one of the housings abut against an inner surface of the construction module to thereby provide substantially horizontal orientation.

9. A combination according to claim 6, wherein the connector also comprises openings through which settable material is injectable to further secure the construction modules in place by setting around the elongate member inserted into the connector.

* * * * *